United States Patent [19]

Deutsch

[11] 4,146,224

[45] Mar. 27, 1979

[54] TABLE FOOTBALL GAME

[76] Inventor: Jakob Deutsch, Riedhofstrasse 253, CH-8049 Zurich, Switzerland

[21] Appl. No.: 822,089

[22] Filed: Aug. 5, 1977

[30] Foreign Application Priority Data

Aug. 24, 1976 [DE] Fed. Rep. of Germany ..... 2637971

[51] Int. Cl.[2] ..... A63F 7/10

[52] U.S. Cl. ..... 273/85 F; 273/85 B

[58] Field of Search ..... 273/85 F, 85 B, 85 A, 273/85 E

[56] References Cited

U.S. PATENT DOCUMENTS

| | | | |
|---|---|---|---|
| 1,982,491 | 11/1934 | Barnum | 273/85 E |
| 2,229,232 | 1/1941 | Widegren et al. | 273/85 B |
| 2,698,179 | 12/1954 | Widegren et al. | 273/85 B |
| 3,112,930 | 12/1963 | Wertz | 273/85 E |

FOREIGN PATENT DOCUMENTS

| | | | |
|---|---|---|---|
| 539420 | 7/1955 | Belgium | 273/85 F |
| 835596 | 9/1938 | France | 273/85 F |
| 1076450 | 4/1954 | France | 273/85 E |
| 535734 | 11/1955 | Italy | 273/85 F |
| 267626 | 3/1927 | United Kingdom | 273/85 F |

*Primary Examiner*—Richard J. Johnson
*Assistant Examiner*—Harry G. Strappello

[57] ABSTRACT

A table football game including a box-like structure which is open at the top and a field of play in which play figures are arranged displaceably, for which purpose a push rod with its handle protruding outward is provided in each case under the field of play, whereby each play figure is provided with a pivoted leg.

5 Claims, 4 Drawing Figures

1
2
3
4
5
6
7
8
9
10
11
12
13
13a
14
15
16
17
18
19
20
21
22
23
24
25
26
27
29
33
34
35
36
37
38
39
40
41
42
43
44
III
III

TABLE FOOTBALL GAME

BACKGROUND

The present invention relates to a table football game. Various table football games are already known which are used in the home or in amusement premises.

The most widespread table or box football game today is usually designated the Tögglerspiel. The game consists of a rectangular box of up to 80 × 150 cm in size. Eight transverse bars are fitted in the longitudinal sides of the box and on these bars one to five player figures are fixed according to position. Outside the box walls, handles are fastened on the transverse bars, more particularly four on each side. By means of these handles, the players are able to displace the bars transversely to the playing field and to revolve the figures fixed on the bar in a circular motion. The players now attempt by appropriate movements of the figures to propel the ball into the opposing goal.

The great disadvantage of the Tögglerspiel is that vision of the playing field is severely impaired by the many bars and the field of play or action of the figures is extremely limited. Furthermore, a realistic possibility for play in the case of the Tögglerspiel is not feasible because the figures can only be revolved about their bar and lateral displacement is only very limited.

With another known table football game, the figures fixed on a perpendicular drive axis are revolved through a linkage system with a handle outside the playing frame, so that, when it comes within the reach of the foot of the figure, the ball can be "kicked" away. The game figures can be displaced in slots on the playing field area. When the handle is released, the figures are always drawn back to rest position by spring tension.

The field of play has recesses or grooves into which the ball rolls to bring it within the area of a play figure. The ball can be knocked or "kicked" away only by the swivel motion of the figure or by a movement in the direction of the guide slot.

Moreover, an ice hockey game is prior art in which discs or pucks are used. The play figures fastened on the perpendicular drive elements are fitted with hockey sticks. The figures can be moved in slots by means of bars in the longitudinal direction of the field of play and can also be revolved about their own axes. The puck can be propelled away by the stick of the play figure through the swivel motion. The puck can also be knocked away by longitudinal motion of the play figure.

A table football game is also prior art whereby the play figures have a movable leg. The principal of this football game corresponds to that of a Tögglerspiel game. Two, three or five play figures are fastened on the six transverse bars. Lateral displacement of the transverse bars with the play figures is effected by a highly complex mechanism below the level of play. The actuating levers for lateral displacement are located on the four corners outside the frame of play.

Each play figure has a moving foot for "kicking" or knocking away the ball. However, the figures do not swivel and therefore can kick only in the direction of the opposing goal. Drive for the kicking feet is also derived from a complicated linkage system, which has to be actuated by the feet of the players of the game. All feet of the play figures fastened on the relevant bar are moved simultaneously.

The field of play is not flat, but convex, so that the ball always rolls back into the area of a play figure.

All of these known games have the disadvantage that the play figures cannot shoot the ball in an accurate direction. Whereas the direction in which the ball is shot is generally toward the opposing goal, its point of actual arrival is a matter of chance. The invention is devoted to creating a game in which every play figure can shoot accurately, as a result of which the game becomes far more interesting and realistic.

SUMMARY

Hereby the invention is based on a game comprising a box-like structure which is open at the top and a field of play in which play figures are arranged displaceably, for which purpose a pushrod with its handle protruding outward is provided in each case under the field of play, whereby each play figure is provided with a pivoted leg.

According to this invention, the game is characterized in that a small gearbox, displaceable by means of a pushrod, is arranged below each slot upon which is mounted a play figure on a hollow vertical shaft which protrudes through the slot and which, with the aid of the pushrod seated pivotally in the small gearbox and in conjunction with a gear system disposed therein, permits rotation of the hollow vertical shaft carrying the play figure and wherein a lever is disposed in the area of the pushrod handle which permits actuation of the pivoted leg of the play figure through a Bowden cable linkage and an articulated system connected positively to the bar penetrating the hollow vertical shaft.

DRAWINGS

The drawing depicts an embodiment of the subject of the invention, whereby:

DESCRIPTION

Figure 1:
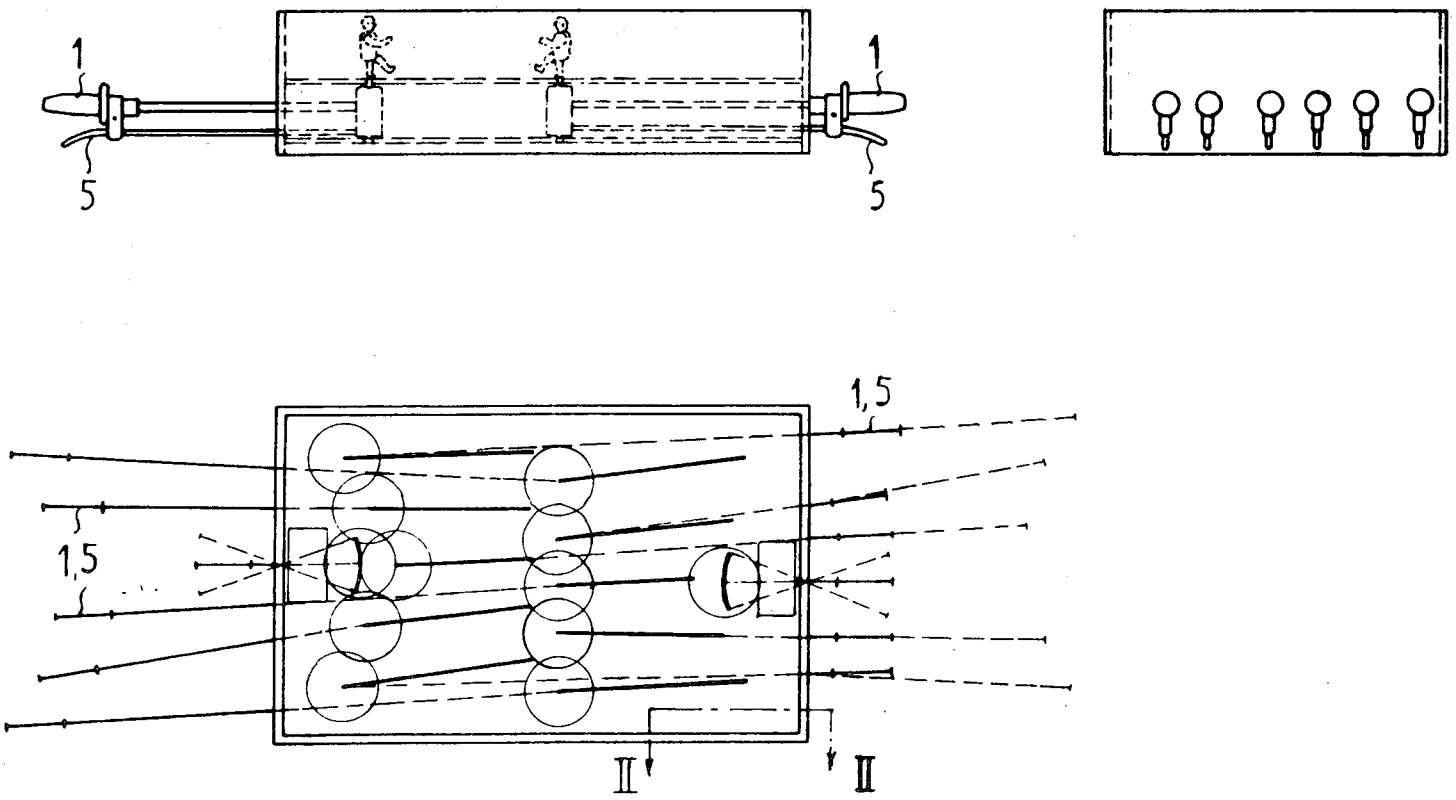
FIG. 1 shows a general diagrammatic view of the game viewed from the side, from above and from one end with the operating handles.

The field of play incorporates for each of the two teams five straight slots for field play figures and a circular segment slot for the goalkeeper figure. The play figures on the left side depicted in the plan elevation in FIG. 1 are pulled back fully and those on the right are advanced fully. The drawn circles depict the fields of action of the individual play figures. From this it is seen that the play figures cover virtually the entire field of play. Owing to the conical rim 13*a* any ball which has rolled to the back rolls automatically back into the field of play.

In FIG. 1, it is apparent that each team consists of one goalkeeper, two defenders and three strikers. The play figures revolve about their own axes by 360° in all directions and can be slid back and forth in the area of play within guide slots. Each play figure has a kicking foot which can be operated by a lever 5 under handle 1. The ball can be kicked, according to the wish of the player, gently or hard, flat over the field of play or in an arc above the heads of the other play figures and in any direction, more particularly irrespective of positioning within the slot.

Figure 2:
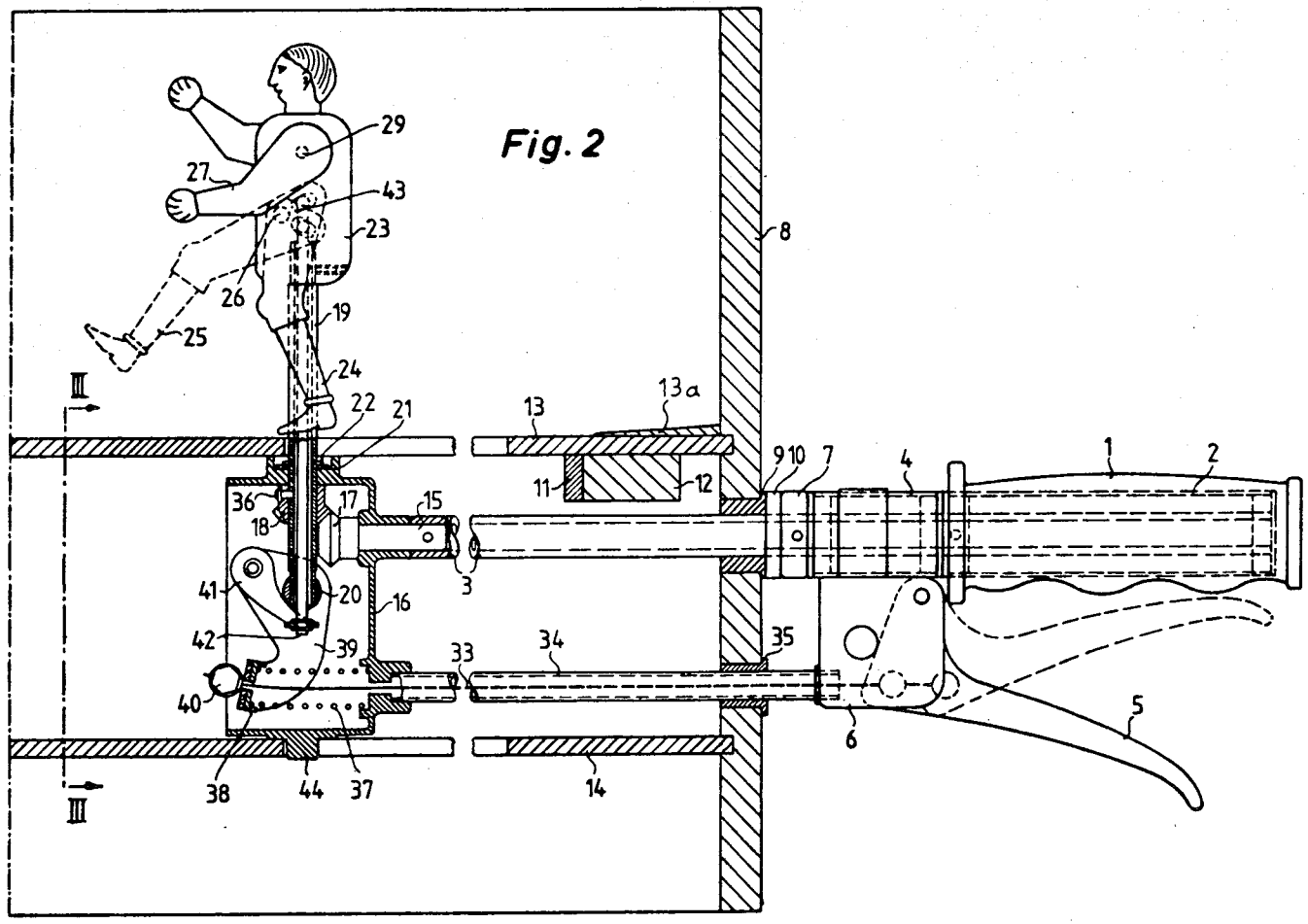
FIG. 2 shows part of a longitudinal section along the line II—II in FIG. 1.
Figure 3:
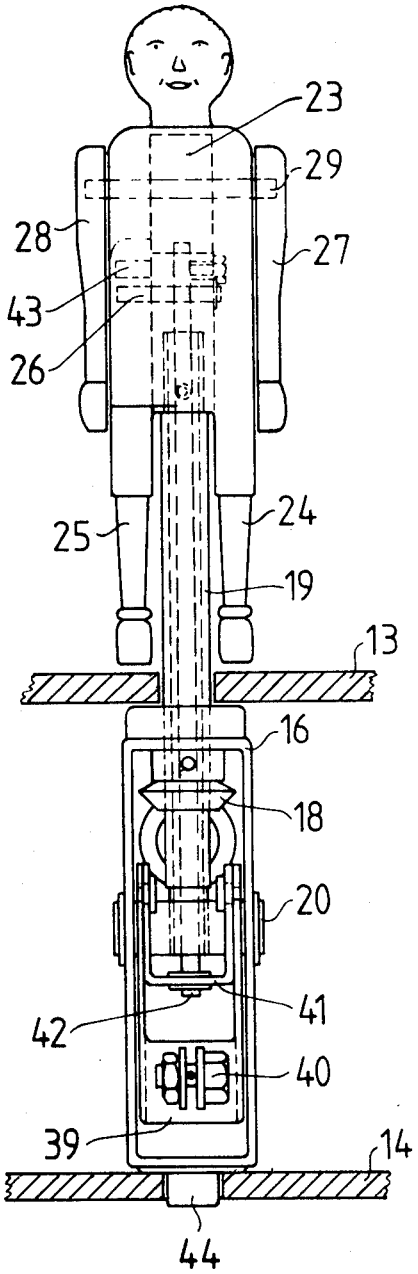
FIG. 3 shows a section along the line III—III in FIG. 2.

The functional principles of the play figures can be described on the basis of FIGS. 2 and 3.

The plastic handle 1 (Velo-control handle) is slid onto a length of tube 2 which is connected firmly with pushrod 3. A collar 4 is positioned loosely on the pushrod in front of the handle 1. The lever mount 6 is clamped firmly onto this bearing collar 4. An adjusting collar 7 is pinned firmly on pushrod 3 in front of bearing collar 4 and thus locates collar 4. The lever 5 is used to actuate the pivoted leg 25 of the play figures. Lever 5 and mounting 6 are standard components of normal bicycle brakes.

Pushrod 3 leads through the frame 8 and is seated in a plastic bush 9. A foam rubber ring 10 is inserted to act as a damper between set collar 7 and bush 9. The foam rubber pad 11 with limit stop 12 also serves as a travel limiter and obstructs the path of small gearbox 16 when the pushrod is drawn out to its maximum limit. The two limit stops buffers 10 and 11 respectively prevent wear to the guide slots in field of play panel 13 and bottom panel 14.

Pushrod 3 is connected firmly with bevel pinion 15, which is seated in a bearing bush of small gearbox 16 and pinned to bevel gear 17. Bevel gear 17 meshes with a bevel gear 18, which is mounted on the perpendicular hollow shaft 19 with which it is coupled positively, for example by means of bolt 36 and retaining collar. Each rotary motion of handle 1 is transmitted via 2, 3, 15, 17, 18 to hollow shaft 19 in a direct ratio of 1:1. Hollow shaft 19 is seated at the bottom in journal 20 and at the top in an appropriate bearing bush. Hollow shaft 19 is held in correct position by a circlip 22. The basic play figure 23 and the fixed leg 24 is fixed onto the upper part of hollow shaft 19.

The moving leg 25 is fitted with a fixed bolt 26, which is seated pivotally in basic figure 23 and secured in place by a circlip. Both arms 27 and 28 on the field play figures are seated by an axis 29 in the basic figure in such a way as to allow adjustment to a natural position where they remain.

Figure 4:
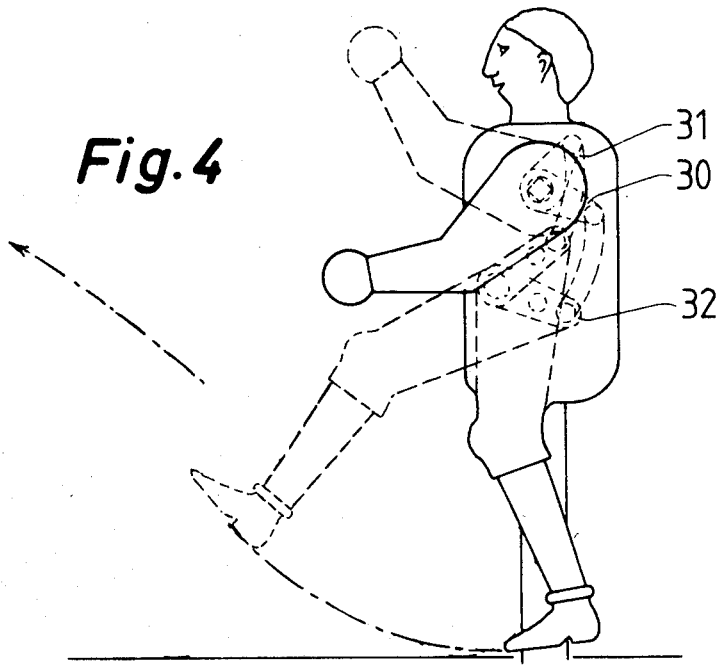
FIG. 4 shows a side elevation of a play figure.

The two goalkeepers, on the other hand, are fitted with movable arms and on these the two arms 27 and 28 are mounted on a rectangular rather than round axis (FIG. 4). This rectangular axis is connected by an articulated mechanism 30, 31, 32, 43 with leg 25 in such a manner that both arms 27 and 28 are raised simultaneously with leg 25, thus allowing balls coming it at head level to be held in the hands.

To actuate the pivoted leg 25 of a play figure, lever 5 must be drawn against handle 1 to draw traction cable 33 to the rear. Traction cable 33 leads within tube 34 from mounting 6 through to small gearbox 16. This connection between mounting 6 and small gearbox 16 insures that lever 5 remains always in perpendicular position, also when handle 1 is twisted.

Bush 35 serves as a guide for tube 34 in the end wall 8 of the game frame.

Traction cable 33 leads within small gearbox 16 through a thrust spring 37, a spring washer 38 and a main lever 39 through the clamp screw 40. Lever 39 is mounted pivotally on journal 20. The position of lever 39 is fixed by adjustment of clamp screw 40 on traction cable 33. The thrust spring 37 holds the traction cable 33 under permanent tension, so that lever 5 is held in rest position against the limit stop of mounting 6. A secondary lever 41 is articulated to the upper part of main lever 39. The secondary lever has a hole bored through its cross web through which traction rod 40 is led. Traction rod 42 leads through hollow shaft 19 to the level of pivoted leg 25. At the bottom end of traction rod 42, the rod is held by two circlips in the cross web of secondary lever 41 in such a way as to permit the rod to revolve easily. Cross-journal 43 is adjustable on the upper section of traction rod 42 and screwed in position.

Journal 43 engages in the small longitudinal slot of pivoted leg 25, which is necessary to compensate the perpendicular motion of traction rod 42 and the pivot motion of leg 25 about its journal.

A sliding journal 44 is provided on the underside of small gearbox 16 to insure smooth and easy displacement of small gearbox 16 in the guide slot of baseplate 14. This form of seating in baseplate 14 also prevents misalignment or jamming of the small gearbox with the play figure in the guide slots.

The slots provided in the field of play can also be curved rather than straight, as depicted in FIG. 1.

What I claim is:

1. A table football game having an open box-like construction with a field of play provided with a plurality of slots within which play figures are disposed to be displaceable, the slots including a first set of slots arranged in a direction longitudinal to the field of play and extending from the end of the field of play to about the middle of the field of play, and two additional slots for goalkeepers arranged in a transverse direction, each of said play figures being displaceable by means of a pushrod positioned below said field of play and extending outwardly through said box-like construction, each of said play figures having a kickfoot that can be individually operated from outside of said box-like construction, the improvement characterized by the combination of the following features:

(a) a small gearbox for each play figure arranged under said field of play and being displaceable in one of said slots by one of said pushrods;

(b) a bevel gearing arranged in each gearbox for actuating the play figure by a hollow vertical shaft which extends through the slot and on which the play figure is mounted;

(c) a spring-loaded lever system arranged in each gearbox for actuating the kickfoot of a play figure by a rod passing through said hollow vertical shaft;

(d) a shaft rotatably mounted within each of said pushrods for actuating the bevel gearing associated with the pushrod;

(e) a tube extending from each gearbox below the associated pushrod and a traction cable within the tube for operating the spring-loaded lever system of the gearbox; and (f) operating means for each pushrod positioned outside of the box-like construction comprising a handle rotatably mounted on the pushrod for rotating the shaft within the pushrod for actuating the bevel gearing and an operating lever mounted below the handle for moving said traction cable to actuate the spring-loaded lever system.

2. The table football game of claim 1 wherein there is disposed below the panel of the field of play and parallel thereto a second panel with slots identical with those of the field of play and a guide journal on the underside of each gearbox engaged in each slot of the second panel.

3. The table football game of claim 1 wherein each play figure has a pivotable leg which includes a kickfoot and an interconnected shin bone shaped to insure that, in its rest position, the kickfoot is able to reach under a ball lying in its vicinity, thereby permitting a realistic elevated shot.

4. The table football game of claim 1 wherein each play figure has a pivotable leg on which the kickfoot is mounted, an actuating journal for the pivotable leg attached to said rod which passes through said vertical shaft, said actuating journal being displaceable in a slot which permits the leg to move backward a little beyond a rest position.

5. The table football game of claim 1 wherein the play figures representing goalkeepers include movable arms which are moved upwardly with the aid of the lever system simultaneously with the kickfoot.

* * * * *